US011193398B2

(12) United States Patent
Hamaoka et al.

(10) Patent No.: US 11,193,398 B2
(45) Date of Patent: Dec. 7, 2021

(54) VALVE TIMING ADJUSTMENT DEVICE, AND METHOD FOR MANUFACTURING SAME

(71) Applicant: DENSO CORPORATION, Kariya (JP)

(72) Inventors: Yasuhiro Hamaoka, Kariya (JP); Tomoyuki Fukuyama, Kariya (JP)

(73) Assignee: DENSO CORPORATION, Kariya (JP)

( * ) Notice: Subject to any disclaimer, the term of this patent is extended or adjusted under 35 U.S.C. 154(b) by 143 days.

(21) Appl. No.: 16/415,008

(22) Filed: May 17, 2019

(65) Prior Publication Data

US 2019/0271240 A1 Sep. 5, 2019

Related U.S. Application Data

(63) Continuation of application No. PCT/JP2017/041231, filed on Nov. 16, 2017.

(30) Foreign Application Priority Data

Nov. 29, 2016 (JP) ..... JP2016-231248

(51) Int. Cl.
*F01L 1/344* (2006.01)
*F01L 1/356* (2006.01)

(52) U.S. Cl.
CPC ..... *F01L 1/3442* (2013.01); *F01L 1/356* (2013.01); *F01L 2001/3445* (2013.01)

(58) Field of Classification Search
CPC ..... F01L 1/3442; F01L 1/356; F01L 1/047; F01L 2001/3445; F01L 2001/34446; F01L 9/10
USPC ..... 123/90.17
See application file for complete search history.

(56) References Cited

U.S. PATENT DOCUMENTS

| | | | | |
|---|---|---|---|---|
| 8,453,616 | B2 | 6/2013 | Eimert | |
| 8,794,201 | B2 | 8/2014 | Eimert | |
| 9,309,789 | B2 * | 4/2016 | Hayashi | F01L 1/3442 |
| 10,550,736 | B2 * | 2/2020 | Amano | F01L 1/356 |
| 2004/0112314 | A1 * | 6/2004 | Kanada | F02D 13/02 123/90.17 |
| 2016/0010516 | A1 * | 1/2016 | Suzuki | F01L 1/3442 123/90.12 |
| 2016/0237862 | A1 * | 8/2016 | Kajita | F01L 1/047 |

FOREIGN PATENT DOCUMENTS

JP 2012-163069 8/2012

* cited by examiner

*Primary Examiner* — Charles G Freay
*Assistant Examiner* — Kelsey L Stanek
(74) *Attorney, Agent, or Firm* — Nixon & Vanderhye P.C.

(57) ABSTRACT

A friction member is clamped between a driven shaft of an internal combustion engine and a vane rotor and includes an oil passage hole. The oil passage hole communicates between a first oil passage of the driven shaft a second oil passage of the vane rotor. Each of positioning arrangements includes a primary engaging portion of the vane rotor and a secondary engaging portion of the friction member. The positioning arrangements are configured to limit relative rotation between the vane rotor and the friction member in a communicating state where the first oil passage and the second oil passage are communicated with each other through the oil passage hole.

8 Claims, 13 Drawing Sheets

VALVE TIMING ADJUSTMENT DEVICE, AND METHOD FOR MANUFACTURING SAME

CROSS REFERENCE TO RELATED APPLICATIONS

This application is a continuation application of International Patent Application No. PCT/JP2017/041231 filed on Nov. 16, 2017, which designated the U.S. and claims the benefit of priority from Japanese Patent Application No. 2016-231248 filed on Nov. 29, 2016. The entire disclosures of all of the above applications are incorporated herein by reference.

TECHNICAL FIELD

The present disclosure relates to a valve timing adjustment device and a method for manufacturing the same.

BACKGROUND

There has been proposed a hydraulic valve timing adjustment device that is configured to adjust valve timing of intake valves or exhaust valves of an internal combustion engine by implementing relative rotation of a vane rotor upon supplying hydraulic oil to one of hydraulic oil chambers of a housing while discharging the hydraulic oil from the other one of the hydraulic oil chambers.

SUMMARY

A valve timing adjustment device of the present disclosure is placed in a drive force transmission path, which transmits a drive force from a drive shaft of an internal combustion engine to a driven shaft of the internal combustion engine, while the valve timing adjustment device is configured to adjust valve timing of a valve that is opened and closed by the driven shaft. The valve timing adjustment device includes a housing, a vane rotor and a friction member.

The housing is configured to be rotated synchronously with a first shaft that is one of the drive shaft and the driven shaft. The vane rotor is fixed to an end part of a second shaft, which is the other one of the drive shaft and the driven shaft, to rotate synchronously with the second shaft. The vane rotor includes a vane that partitions an inside space of the housing into a primary oil pressure chamber placed at one circumferential side and a secondary oil pressure chamber placed at another circumferential side, and the vane rotor is configured to rotate relative to the housing according to a pressure of hydraulic oil, which is supplied to the primary oil pressure chamber, and a pressure of the hydraulic oil, which is supplied to the secondary oil pressure chamber. The friction member is clamped between the second shaft and the vane rotor and includes an oil passage hole.

BRIEF DESCRIPTION OF DRAWINGS

The present disclosure, together with additional objectives, features and advantages thereof, will be best understood from the following description in view of the accompanying drawings.

DETAILED DESCRIPTION

Figure 1:
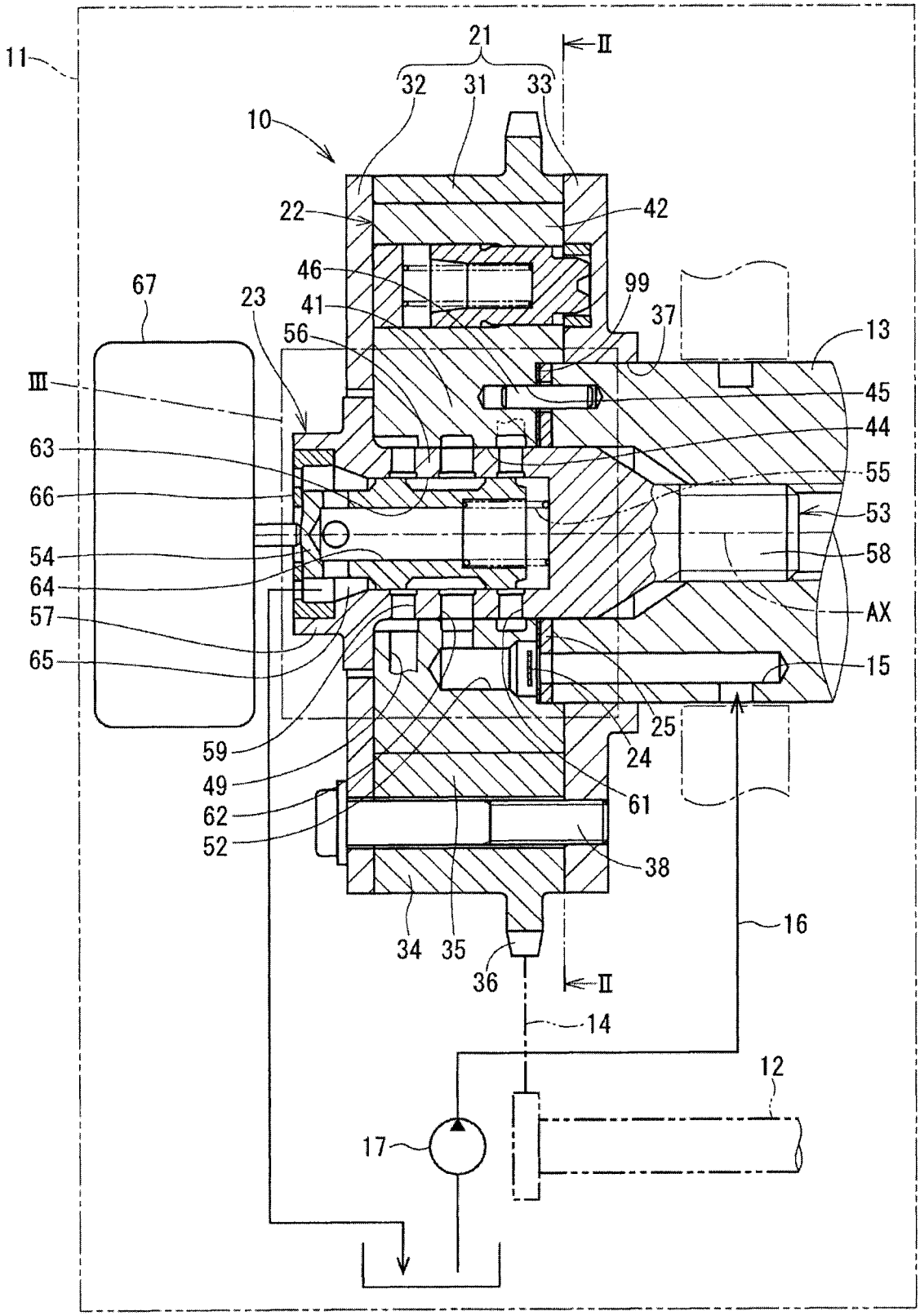
FIG. 1 is a cross sectional view for describing a schematic structure of a valve timing adjustment device according to a first embodiment.

There has been proposed a hydraulic valve timing adjustment device that is configured to adjust valve timing of intake valves or exhaust valves of an internal combustion engine by implementing relative rotation of a vane rotor upon supplying hydraulic oil to one of hydraulic oil chambers of a housing while discharging the hydraulic oil from the other one of the hydraulic oil chambers. For instance, in one previously proposed hydraulic valve timing adjustment device, the vane rotor is fixed to an end part of the camshaft, and a friction disk is placed between the camshaft and the vane rotor. The supply and the discharge of the hydraulic oil are carried out through oil passages of the camshaft and oil passages of the vane rotor, which are connected to each other. The friction disk includes: an outer ring, which is positioned on a radially outer side of the oil passages of the camshaft and the oil passages of the vane rotor; an inner ring, which is positioned on a radially inner side of the oil passages of the camshaft and the oil passages of the vane rotor; and five arms, which extend in a radial direction to connect between the outer ring and the inner ring.

In the previously proposed hydraulic valve timing adjustment device, a circumferential interval between circumferentially adjacent two of the arms arranged one after the other in the circumferential direction is set to be smaller than a circumferential interval between the two oil passages of the vane rotor. Therefore, the two oil passages are not simultaneously closed by the arms. However, depending on the assembled state, one of the oil passages may possibly be closed by the arm. Therefore, a pressure loss may possibly be generated at the oil passage that is closed by the arm.

A valve timing adjustment device of the present disclosure is placed in a drive force transmission path, which transmits a drive force from a drive shaft of an internal combustion engine to a driven shaft of the internal combustion engine, while the valve timing adjustment device is configured to adjust valve timing of a valve that is opened and closed by the driven shaft. The valve timing adjustment device includes a housing, a vane rotor and a friction member.

The housing is configured to be rotated synchronously with a first shaft that is one of the drive shaft and the driven shaft. The vane rotor is fixed to an end part of a second shaft, which is the other one of the drive shaft and the driven shaft, to rotate synchronously with the second shaft. The vane rotor includes a vane that partitions an inside space of the housing into a primary oil pressure chamber placed at one circumferential side and a secondary oil pressure chamber placed at another circumferential side, and the vane rotor is configured to rotate relative to the housing according to a pressure of hydraulic oil, which is supplied to the primary oil pressure chamber, and a pressure of the hydraulic oil, which is supplied to the secondary oil pressure chamber. The friction member is clamped between the second shaft and the vane rotor and includes an oil passage hole. The oil passage hole communicates between a first oil passage, which is opened at an axial end surface of the second shaft, and a second oil passage, which is opened at an axial end surface of the vane rotor.

Furthermore, the valve timing adjustment device includes at least one positioning arrangement. The at least one positioning arrangement includes a primary engaging portion, which is provided at the vane rotor, and a secondary engaging portion, which is provided to the friction member and is configured to circumferentially engage with the primary engaging portion. The at least one positioning arrangement is configured to limit relative rotation between the vane rotor and the friction member in a communicating state where the first oil passage and the second oil passage are communicated with each other through the oil passage hole.

By providing the positioning arrangement in the above-described manner, the valve timing adjustment device is assembled to the second shaft while the communicating state between the first oil passage and the second oil passage is maintained through the oil passage hole. Therefore, it is possible to avoid closing of the first oil passage of the vane rotor and the second oil passage of the second shaft by the friction member. Thus, occurrence of the pressure loss caused by the closing of the oil passage by the friction member can be limited.

Hereinafter, various embodiments will be described with reference to the drawings. Structures, which are substantially identical to each other in the following embodiments, will be indicated by the same reference signs and will not be described redundantly for the sake of simplicity.

First Embodiment

FIG. 1 shows a valve timing adjustment device according to a first embodiment. The valve timing adjustment device 10 adjusts valve timing of an intake valve (not shown), which is opened and closed by a camshaft 13, by rotating the camshaft 13 relative to a crankshaft 12 of the internal combustion engine 11. The valve timing adjustment device 10 is placed in a drive force transmission path, which extends from the crankshaft 12 to the camshaft 13. The crankshaft 12 serves as a drive shaft. The camshaft 13 serves as a driven shaft.

<Overall Structure>

First of all, an overall structure of the valve timing adjustment device 10 will be described.

Figure 2:
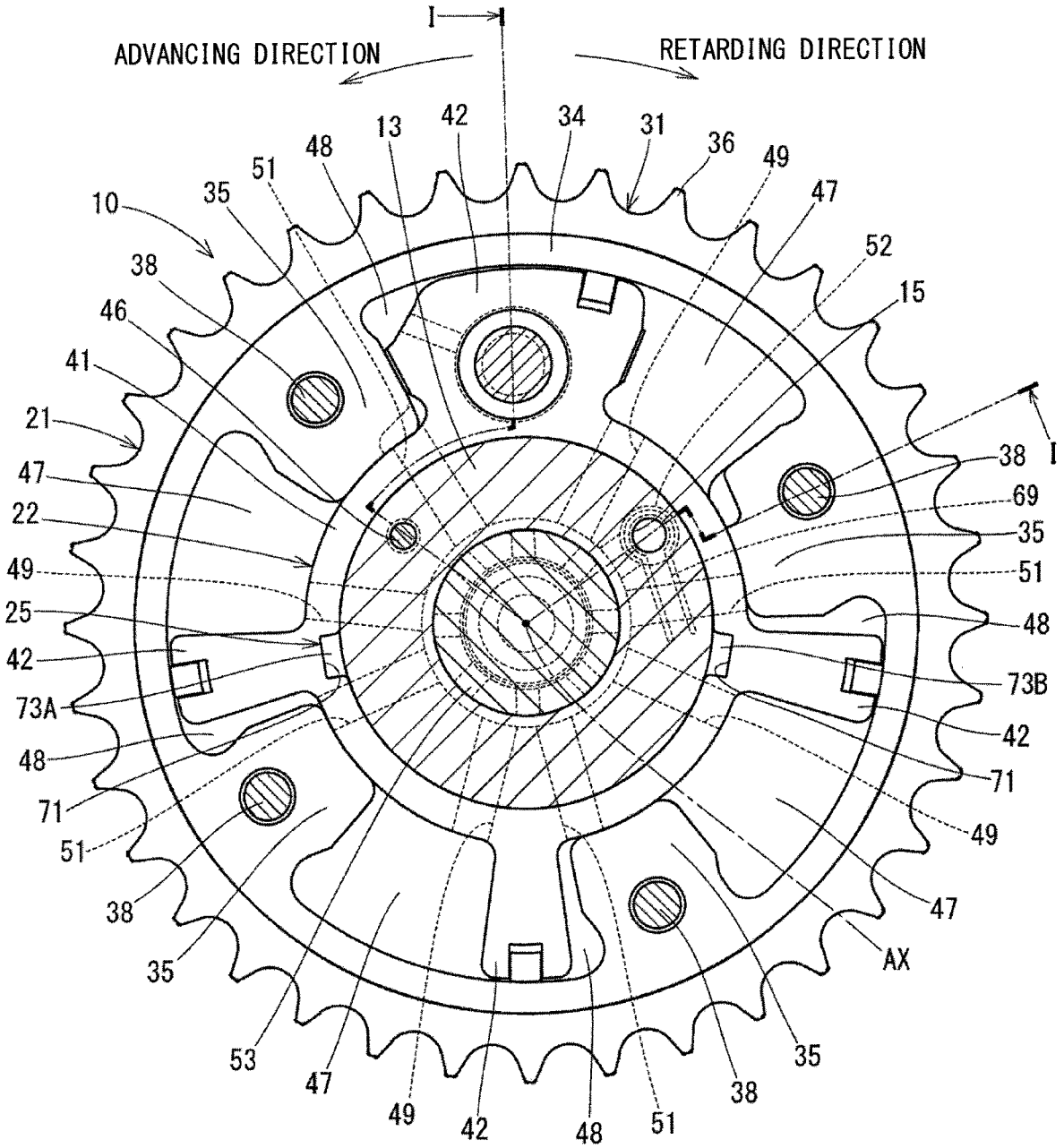
FIG. 2 is a cross sectional view taken along line II-II in FIG. 1.

As shown in FIGS. 1 and 2, the valve timing adjustment device 10 includes a housing 21, a vane rotor 22, a spool valve 23, a reed valve 24 and a friction member 25. FIG. 1 is a cross sectional view taken along line I-I in FIG. 2.

The housing 21 includes a tubular case 31, a front plate 32 and a rear plate 33. The tubular case 31 is coaxial with the camshaft 13 and includes a tubular portion 34 and a plurality of projections 35. A sprocket 36 is formed at an outer wall of the tubular portion 34. The sprocket 36 is coupled to the crankshaft 12 through a timing chain 14. The projections 35 radially inwardly project from the tubular portion 34. The front plate 32 is placed on one side of the tubular case 31 in an axial direction. The rear plate 33 is placed on the other side of the tubular case 31 in the axial direction. The camshaft 13 is inserted into a shaft insertion hole 37 that is formed at a center part of the rear plate 33.

The tubular case 31, the front plate 32 and the rear plate 33 are fixed together with bolts 38. The housing 21 is rotated synchronously with the crankshaft 12. The tubular case 31 serves as a tubular portion. The front plate 32 serves as a first cover portion. The rear plate 33 serves as a second cover portion.

The vane rotor 22 includes a boss 41 and a plurality of vanes 42. The boss 41 includes: a bottomed hole 43, which is formed at a center part of an end portion of the boss 41 located on the camshaft 13 side; and a sleeve insertion hole 44, which extends through a central axis of the boss 41. A relative rotational position of the vane rotor 22 relative to the camshaft 13 is determined by a knock pin 46 that is press fitted into a knock pin hole 45. Furthermore, the vane rotor 22 is fixed to an end part of the camshaft 13 by a sleeve bolt 53 that is inserted into the sleeve insertion hole 44. The vanes 42 radially outwardly project from the boss 41, and each vane 42 partitions a corresponding inside space (i.e., a spaced located between corresponding adjacent two of the projections 35) of the housing 21 into an advancing chamber 47, which is placed at one circumferential side, and a retarding chamber 48, which is placed at another circumferential side. The advancing chamber 47 serves as a primary oil pressure chamber. The retarding chamber 48 serves as a secondary oil pressure chamber. The knock pin 46 serves as a pin.

The vane rotor 22 includes a plurality of advancing oil passages 49, a plurality of retarding oil passages 51 and a supply oil passage 52. Each of the advancing oil passages 49 connects between the corresponding advancing chamber 47 and the sleeve insertion hole 44. Each of the retarding oil passages 51 connects between the corresponding retarding chamber 48 and the sleeve insertion hole 44. One end of the supply oil passage 52 is opened at a bottom surface of the bottomed hole 43, and the other end of the supply oil passage 52 is opened at the sleeve insertion hole 44. The supply oil passage 52 serves as a second oil passage.

An external supply oil passage 15 of the camshaft 13 is communicated with an oil pump 17 through an oil passage 16 of, for example, an engine block. The supply oil passage 52 is connected to the external supply oil passage 15 through the reed valve 24 and the friction member 25. The external supply oil passage 15 serves as a first oil passage.

The vane rotor 22 is rotated relative to the housing 21 according to a pressure of the hydraulic oil supplied to the advancing chambers 47 and a pressure of the hydraulic oil supplied to the retarding chambers 48 to change a rotational phase of the vane rotor 22 relative to the housing 21 toward the advancing side or the retarding side.

The spool valve 23 includes a sleeve bolt 53, a spool 54 and a spring 55. The sleeve bolt 53 includes: a sleeve 56, which is shaped into a tubular form; a head portion 57, which is formed at one axial end part of the sleeve 56; and a threaded portion 58, which is formed at the other axial end part of the sleeve 56. The sleeve 56 includes: an advancing port 59, which is connected to the advancing oil passages 49; a retarding port 61, which is connected to the retarding oil passages 51, and a supply port 62, which is connected to the supply oil passage 52. Each port is a hole that radially extends through the sleeve 56 and functions as a part of the oil passage. The sleeve 56 is a valve body of the spool valve 23.

Figure 3:
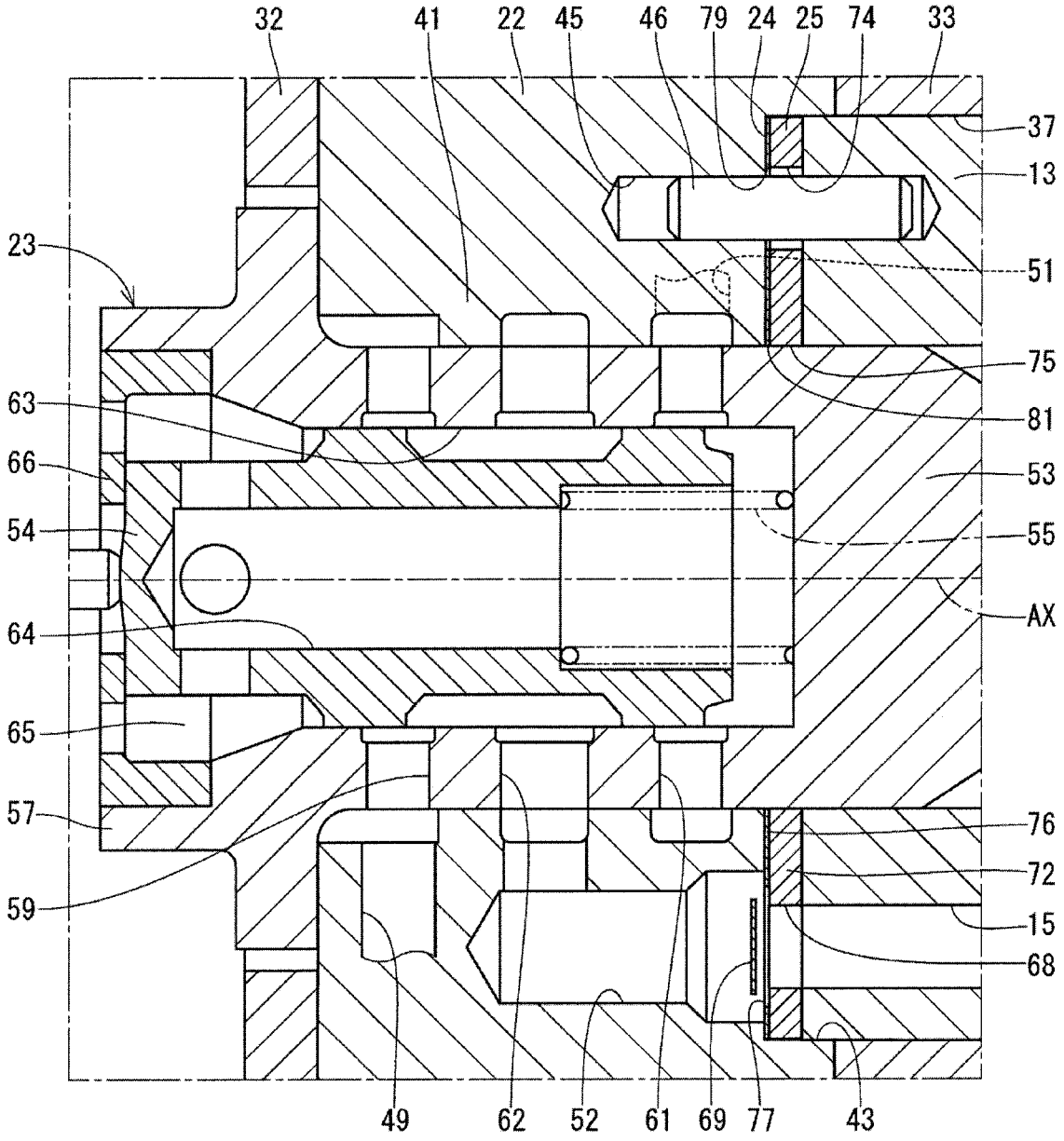
FIG. 3 is an enlarged view of an area III of FIG. 1 showing a state where hydraulic oil is supplied to advancing chambers, and the hydraulic oil is drained from retarding chambers.
Figure 4:
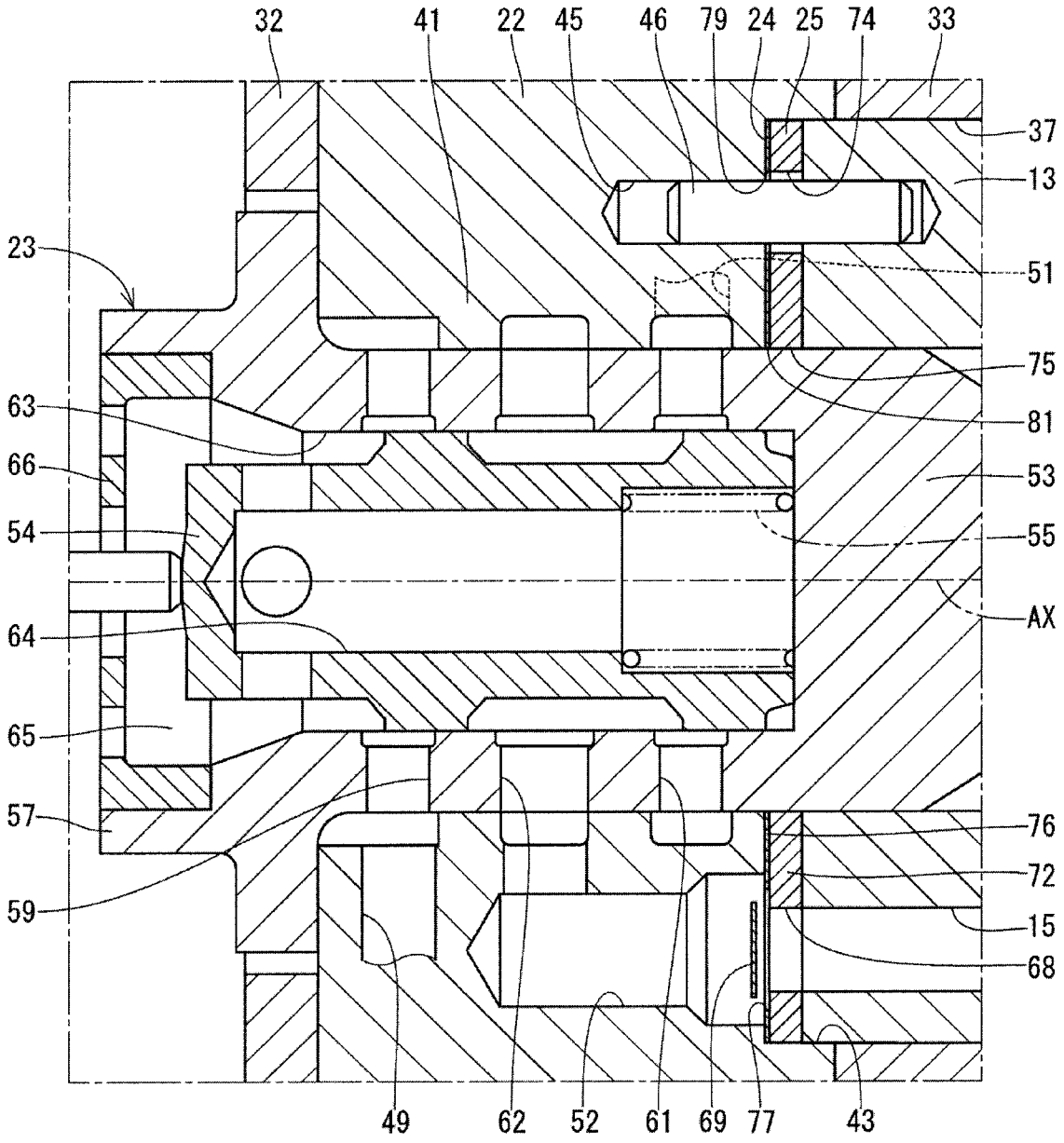
FIG. 4 is an enlarged view showing the same area as that of FIG. 3 and indicating a state where hydraulic oil is supplied to the retarding chambers, and the hydraulic oil is drained from the advancing chambers.

The spool 54 is inserted into a spool insertion hole 63 of the sleeve 56 and is configured to axially reciprocate in the inside of the sleeve 56. The corresponding ports are connected with each other according to an axial position of the spool 54. Specifically, at the time of supplying the hydraulic oil to the advancing chambers 47 while draining the hydraulic oil from the retarding chambers 48, the advancing port 59 is connected to the supply port 62, and the retarding port 61 is connected to a drain oil passage 64 formed in an inside of the spool 54, as shown in FIG. 3. In contrast, at the time of supplying the hydraulic oil to the retarding chambers 48 while draining the hydraulic oil from the advancing chambers 47, the retarding port 61 is connected to the supply port 62, and the advancing port 59 is connected to a drain space 65 formed in an inside of the head portion 57, as shown in FIG. 4. The drain oil passage 64 is communicated to the outside through the drain space 65.

The spring 55 is placed between the spool 54 and the threaded portion 58 and urges the spool 54 toward one side in the axial direction. Movement of the spool 54 toward the one side in the axial direction is limited by a stopper plate 66 placed in the inside of the head portion 57. An axial position of the spool 54 is determined by balance between an urging force of the spring 55 and an urging force of a linear solenoid 67. The linear solenoid 67 is placed on an opposite side of the spool 54 that is opposite from the spring 55.

The reed valve 24 and the friction member 25 are fitted into the bottomed hole 43 and are clamped between the camshaft 13 and the vane rotor 22. A surface roughness of the friction member 25 is relatively high, so that friction, which is generated between the friction member 25 and mating members at the time of tightening the sleeve bolt 53, is increased. Furthermore, the friction member 25 includes an oil passage hole 68 that communicates between the external supply oil passage 15 and the supply oil passage 52. The reed valve 24 includes a reed 69 that is flexible and is configured to open and close the oil passage hole 68, and thereby the reed valve 24 enables flow of the hydraulic oil from the external supply oil passage 15 to the supply oil passage 52 and limits flow of the hydraulic oil from the supply oil passage 52 to the external supply oil passage 15. In this way, backflow of the hydraulic oil of the supply oil passage 52 toward the external supply oil passage 15 is limited. The friction member 25 serves as a friction member.

In the valve timing adjustment device 10, which is constructed in the above-described manner, in a case where the rotational phase is on a retarding side of a target value, the spool 54 is axially moved to a position shown in FIG. 3, and thereby the hydraulic oil is supplied to the advancing chambers 47, and the hydraulic oil is drained from the retarding chambers 48. In this way, the vane rotor 22 is rotated in the advancing direction relative to the housing 21.

Furthermore, in a case where the rotational phase is on the advancing side of the target value, the spool 54 is axially moved to the position shown in FIG. 4, and thereby the hydraulic oil is supplied to the retarding chambers 48, and the hydraulic oil is drained from the advancing chambers 47. In this way, the vane rotor 22 is rotated in the retarding direction relative to the housing 21.

Furthermore, in a case where the rotational phase coincides with the target value, the advancing chambers 47 and the retarding chambers 48 are closed by the outer wall surface of the spool 54. In this way, the pressure of the advancing chambers 47 and the pressure of the retarding chambers 48 are maintained, and thereby the rotational phase is maintained.

<Characteristic Structure>

Next, a characteristic structure of the valve timing adjustment device 10 will be described.

(Vane Rotor)

Figure 5:
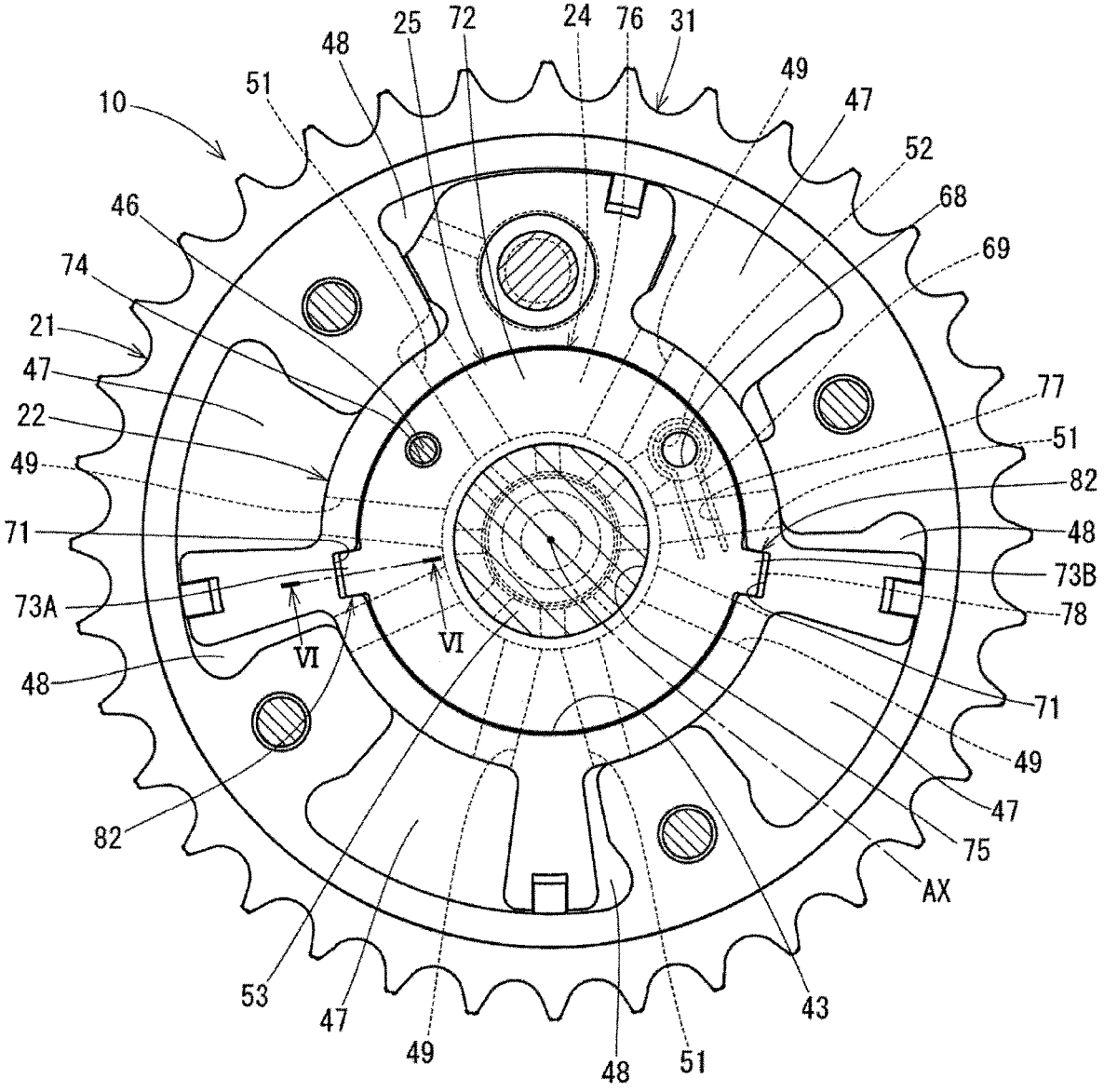
FIG. 5 is a cross sectional view, in which a camshaft is removed from FIG. 2.
Figure 6:
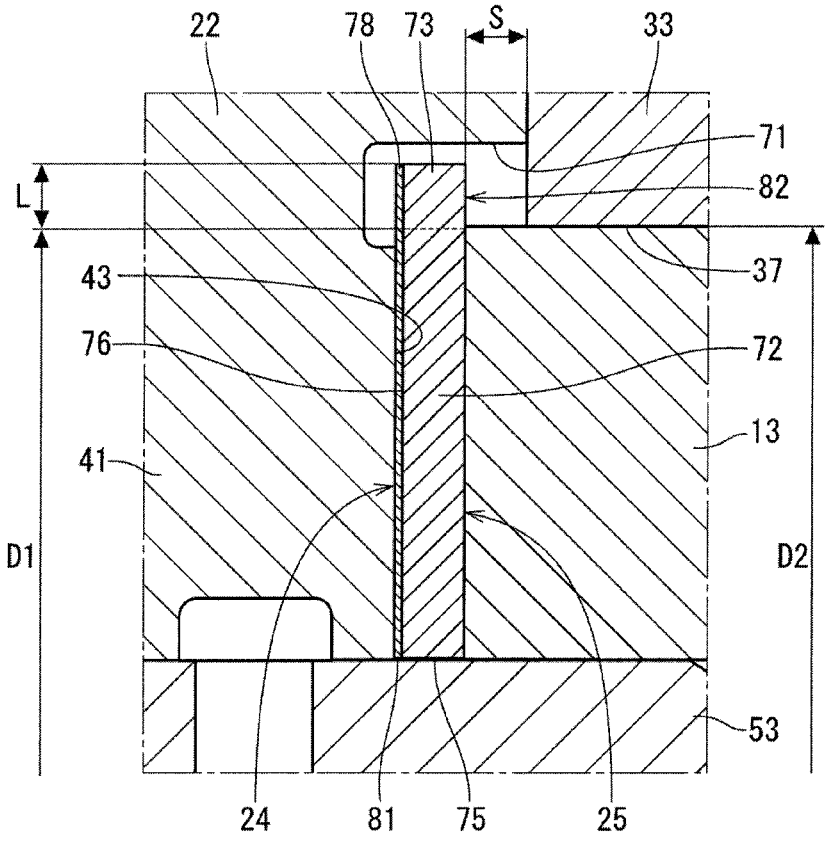
FIG. 6 is a diagram showing a cross section taken along line VI-VI in FIG. 2 and indicating a projection of a friction member at an upper side of FIG. 6.

As shown in FIGS. 5 and 6, the vane rotor 22 includes a plurality of grooves 71. Each groove 71 is formed as a recess that is recessed radially outward at a peripheral wall portion of the bottomed hole 43 and axially extends to an opening of the bottomed hole 43. In the present embodiment, the grooves 71 are formed at two circumferential locations, respectively.

(Friction Member)

As shown in FIGS. 3 to 7, the friction member 25 includes: a main body portion 72, which is shaped into a disc form and is clamped between the vane rotor 22 and the camshaft 13; and a plurality of projections 73, which radially outwardly project from the main body portion 72 at circumferential locations that respectively correspond to the circumferential locations of the grooves 71. The main body portion 72 includes: the oil passage hole 68; a pin insertion hole 74, through which the knock pin 46 is inserted; and a sleeve insertion hole 75, through which the sleeve 56 is inserted. A gap is formed between the knock pin 46 and the pin insertion hole 74. The projections 73 are inserted into the grooves 71, respectively. In the present embodiment, the number of the projections 73 is two. Hereinafter, in a case where the two projections 73 are distinguished from each other, the first projection 73 will be indicated as a projection 73A, and the second projection 73 will be indicated as a projection 73B.

Figure 7:
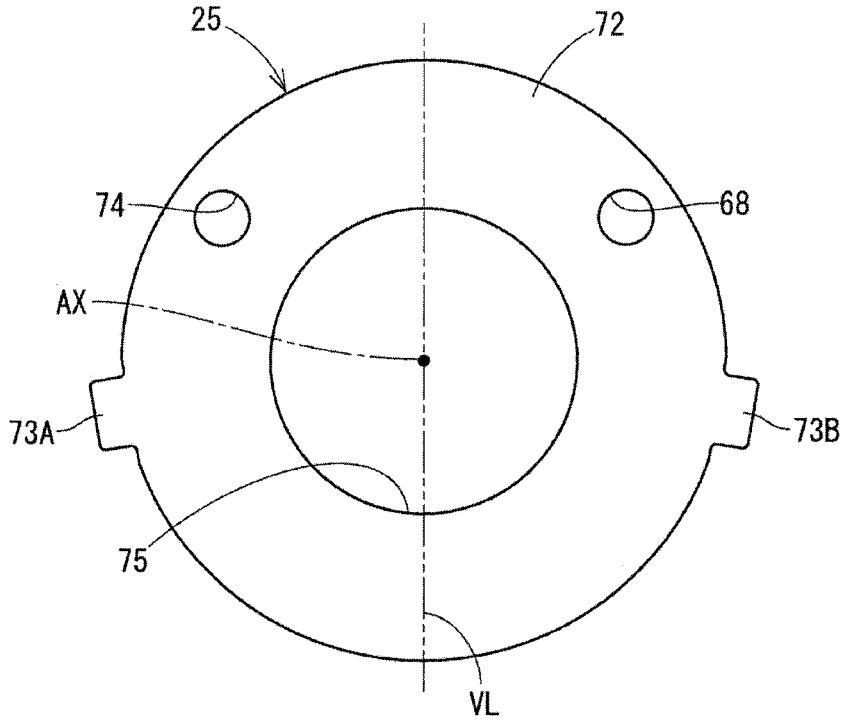
FIG. 7 is a diagram showing the friction member of FIG. 5.
Figure 8:
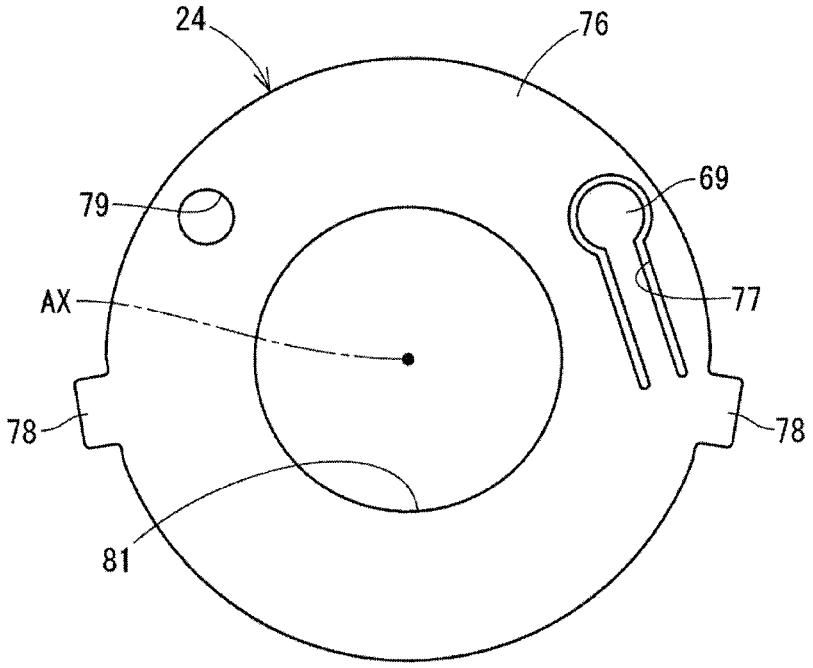
FIG. 8 is a diagram indicating a reed valve of FIG. 5.

As shown in FIG. 7, in the axial view, the friction member 25 is shaped to be line-symmetrical with respect to a predetermined imaginary straight line VL that passes through a rotational center AX of the friction member 25. Specifically, in the axial view, the main body portion 72 is shaped into a form of a circle. The projection 73A and the projection 73B are formed at the corresponding locations, at which the projection 73A and the projection 73B are line-symmetrical with respect to the imaginary straight line VL. A size of the oil passage hole 68 and a size of the pin insertion hole 74 are identical to each other, and the oil passage hole 68 and the pin insertion hole 74 are positioned to be line-symmetrical with respect to the imaginary straight line VL.

(Reed Valve)

As shown in FIGS. 3 to 6 and 8, the reed valve 24 includes: a main body portion 76, which is shaped into a disc form and is clamped between the vane rotor 22 and the camshaft 13; the reed 69, which projects from an edge of a through hole 77 of the main body portion 76; and a plurality of projections 78, which radially outwardly project from the main body portion 76 at circumferential locations that correspond to the circumferential locations of the grooves 71. The main body portion 76 includes: the through hole 77, a pin insertion hole 79, through which the knock pin 46 is inserted; and a sleeve insertion hole 81, through which the sleeve 56 is inserted. The projections 78 are respectively inserted into the grooves 71. In the present embodiment, the number of the projections 78 is two.

(Positioning Arrangement)

As shown in FIGS. 3, 5 and 6, the valve timing adjustment device 10 includes a plurality of positioning arrangements 82, each of which includes a corresponding one of the corresponding grooves 71 and a corresponding one of the projections 73. Each groove 71 is formed at the vane rotor 22 and serves as a primary engaging portion. Each projection 73 is formed at the friction member 25 and is circumferentially engaged with an inner wall surface of the corresponding groove 71 to serve as a secondary engaging portion. The positioning arrangements 82 are configured to limit relative rotation between the vane rotor 22 and the friction member 25 in a communicating state where the external supply oil passage 15 and the supply oil passage 52 are communicated with each other through the oil passage hole 68. The rotation limitation by the positioning arrangements 82 also functions in a state before the assembling of the valve timing adjustment device 10 to the camshaft 13. In the present embodiment, the positioning arrangements 82 are placed at two circumferential locations, respectively.

(Projections)

As shown in FIG. 7, in the axial view, the projection 73A is placed on an opposite side of the rotational center AX of the friction member 25, which is opposite from the projection 73B. Specifically, the projection 73A and the projection 73B are substantially opposed to each other about the rotational center AX.

As shown in FIG. 6, an axial thickness of each projection 73 is the same as an axial thickness of the main body portion 72. Two side surfaces of the friction member 25, which are opposed to each other, are planar surfaces, respectively, which are parallel to each other. Specifically, the friction member 25 is a plate member having a constant thickness and can be formed only by a press punching process. In the present embodiment, after the press punching process, the two side surfaces of the friction member 25 are polished.

An outer diameter D1 of the main body portion 72 is smaller than an inner diameter D2 of the shaft insertion hole 37. Specifically, in the state before the assembling of the valve timing adjustment device 10 to the camshaft 13, if the friction member 25 has only the main body portion 72, the friction member 25 may fall down to the outside through the shaft insertion hole 37. However, in the present embodiment, a distal end of each projection 73 is located on a radially outer side of the inner wall surface of the shaft insertion hole 37. That is, even if the friction member 25 is linearly moved along the bottomed hole 43 in the state before the assembling, the projections 73 abut against the rear plate.

Furthermore, a radial length L of a portion of the projection 73, which is located on the radially outer side of the inner wall surface of the shaft insertion hole 37, is larger than an axial distance S between the projection 73 and the rear plate 33. Specifically, the friction member 25 is formed such that even if the friction member 25 is tilted in the bottomed hole 43 in the state before the assembling, the projection 73 abuts against the rear plate 33.

(Grooves)

As shown in FIG. 5, a circumferential position of each groove 71 coincides with a circumferential position of the corresponding vane 42. Furthermore, a circumferential width of each groove 71 is smaller than a circumferential width of the corresponding vane 42.

<Advantages>

As discussed above, the valve timing adjustment device 10 of the first embodiment includes the friction member 25 and the positioning arrangements 82. The friction member 25 is clamped between the camshaft 13 and the vane rotor 22 and includes the oil passage hole 68, and the oil passage hole 68 communicates between the external supply oil passage 15, which is opened at the axial end surface of the camshaft 13, and the supply oil passage 52, which is opened at the axial end surface of the vane rotor 22. Each positioning arrangement 82 includes the groove 71, which is formed at the vane rotor 22, and the projection 73, which is provided to the friction member 25 and is circumferentially engaged with the inner wall surface of the groove 71. The positioning arrangements 82 are configured to limit the relative rotation between the vane rotor 22 and the friction member 25 in the communicating state where the external supply oil passage 15 and the supply oil passage 52 are communicated with each other through the oil passage hole 68.

By providing the positioning arrangements 82 in the above-described manner, the valve timing adjustment device 10 is assembled to the camshaft 13 while the communicating state between the external supply oil passage 15 and the supply oil passage 52 through the oil passage hole 68 is maintained. Therefore, it is possible to avoid closing of the supply oil passage 52 of the vane rotor 22 and the external supply oil passage 15 of the camshaft 13 by the friction member 25. Thus, occurrence of the pressure loss caused by the closing of the oil passage by the friction member 25 can be limited.

Furthermore, according to the first embodiment, the friction member 25 includes: the main body portion 72, which is clamped between the vane rotor 22 and the camshaft 13; and the plurality of projections 73, which radially outwardly project from the main body portion 72. Each positioning arrangement 82 includes the groove 71 and the projection 73 while the projection 73 is fitted into the groove 71. As discussed above, the positioning arrangements 82 can be relatively easily formed.

Furthermore, in the first embodiment, the axial thickness of each projection 73 is the same as the axial thickness of the main body portion 72. Therefore, the friction member 25 is the plate member having the constant thickness, and the friction member 25 can be formed only by the press punching process. Furthermore, at the time of polishing the two side surfaces of the friction member 25 after the press punching process, the projections 73 do not interfere with the polishing work.

Furthermore, in the first embodiment, the at least two projections 73 are provided. In the axial view, the projection 73A is placed on the opposite side of the rotational center AX of the friction member 25, which is opposite from the projection 73B. Therefore, in the state before the assembling of the valve timing adjustment device 10 to the camshaft 13, even if the friction member 25 is tilted in the bottomed hole 43, one of the projections 73 abuts against the inner wall surface of the groove 71 or the rear plate 33. Therefore, the falling down of the friction member 25 to the outside is limited in the state before the assembling.

In the first embodiment, the housing 21 includes: the tubular case 31; the front plate 32, which is provided to the one end of the tubular case 31; and the rear plate 33, which is provided to the other end of the tubular case 31. The rear plate 33 includes the shaft insertion hole 37, through which the camshaft 13 is inserted. The vane rotor 22 includes the bottomed hole 43, into which the friction member 25 is fitted. The recesses, which form the positioning arrangements 82, are formed as the grooves 71 that are recessed radially outwardly at a peripheral wall portion of the bottomed hole 43 and axially extend to an opening of the bottomed hole 43. The outer diameter D1 of the main body portion 72 is smaller than the inner diameter D2 of the shaft insertion hole 37. The distal end of each projection 73 is located on the radially outer side of the inner wall surface of the shaft insertion hole 37.

Therefore, the friction member 25 can be installed to the vane rotor 22 by axially inserting the friction member 25 into the bottomed hole 43 at the circumferential position where the projections 73 are aligned with the grooves 71, respectively. In this way, the projections 73 do not contact the peripheral wall surface of the bottomed hole 43, and thereby a scratch is not formed at the peripheral wall surface of the bottomed hole 43. Furthermore, in the state before the assembling to the camshaft 13, the projection 73 abuts against the rear plate 33, and thereby the falling down of the friction member 25 can be limited.

Furthermore, in the first embodiment, the radial length L of the portion of each projection 73, which is located on the radially outer side of the inner wall surface of the shaft insertion hole 37, is larger than the axial distance S between the projection 73 and the rear plate 33. Therefore, the friction member 25 is formed such that even if the friction member 25 is tilted in the bottomed hole 43, the projection 73 abuts against the rear plate 33 in the state before the assembling to the camshaft 13. Thus, the falling down of the friction member 25 can be effectively limited.

Furthermore, according to the first embodiment, in the axial view, the friction member 25 is shaped to be line-symmetrical with respect to the predetermined imaginary straight line VL that passes through the rotational center AX of the friction member 25. In this way, the friction member 25 can be assembled regardless of whether the front side or the rear side of the friction member 25 faces the bottom of the bottomed hole 43. Thus, easiness of assembly is improved.

Furthermore, in the first embodiment, the positioning arrangements 82 are placed at the corresponding circumferential locations, respectively. Therefore, in the state before the assembling to the camshaft 13, rattling of the friction member 25 relative to the vane rotor 22 is limited. For example, when the first projection 73A attempts to move in a direction toward the outside of the corresponding groove 71, the second projection 73B abuts against the inner wall surface of the groove 71. Thereby, the movement of the friction member 25 is limited. Thus, the communicating state between the external supply oil passage 15 and the supply oil passage 52 through the oil passage hole 68 can be more correctly maintained.

Furthermore, according to the first embodiment, the circumferential position of each groove 71 coincides with the circumferential position of the corresponding vane 42. Furthermore, the circumferential width of each groove 71 is smaller than the circumferential width of the corresponding vane 42. Thereby, a required wall thickness of a portion of the vane rotor 22, which is located on the radially outer side of the groove 71, can be ensured by the vane 42. Thus, the size of the vane rotor 22, which is measured in the radial direction, can be minimized.

Second Embodiment

Figure 9:
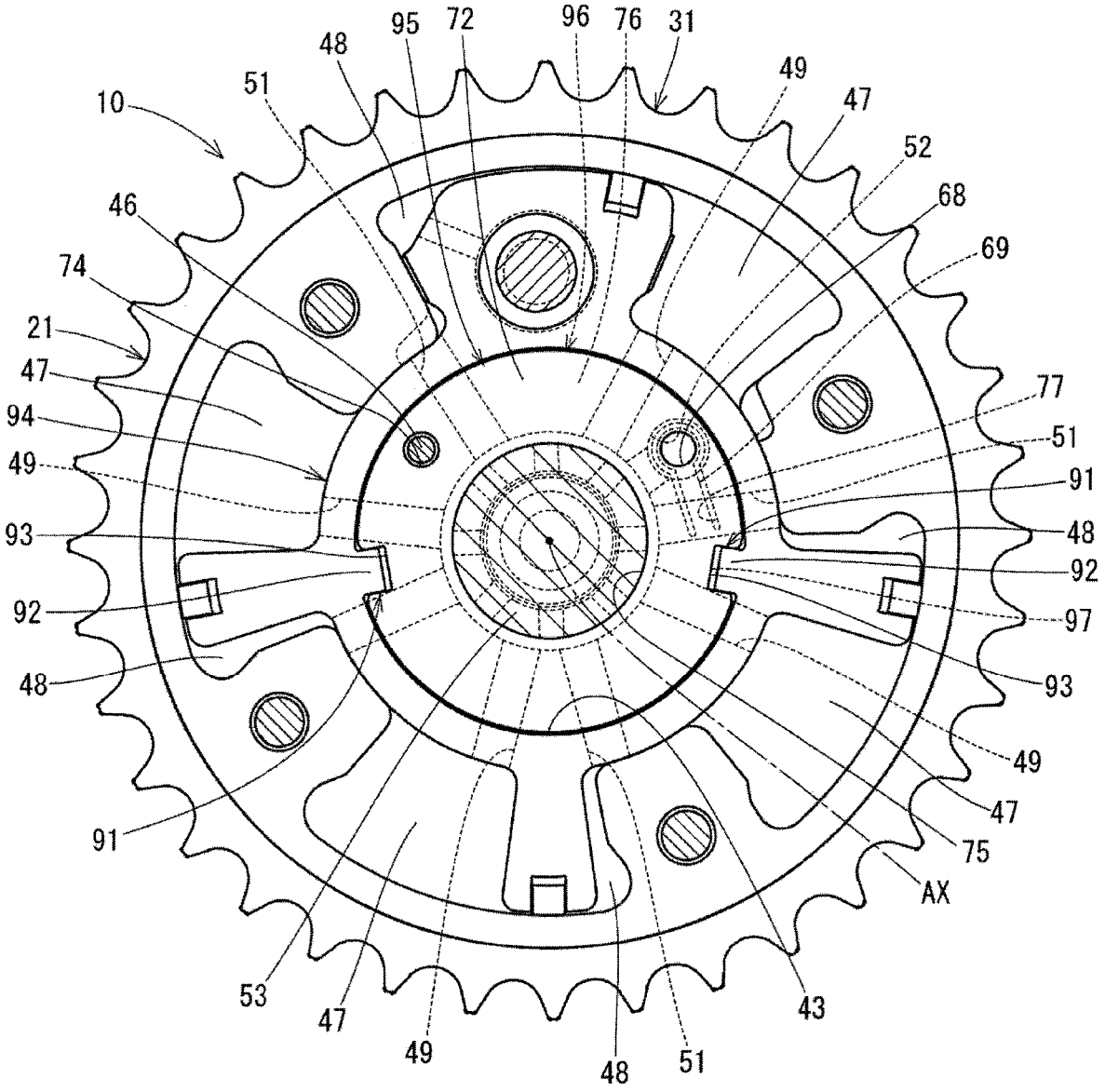
FIG. 9 is a transverse cross sectional view of a valve timing adjustment device of a second embodiment, corresponding to FIG. 5 of the first embodiment.

In a second embodiment, as shown in FIG. 9, each of positioning arrangements 91 includes a corresponding one of projections 92 and a corresponding one of grooves 93. Each projection 92 is formed at the vane rotor 94 and serves as a primary engaging portion. Each groove 93 is formed at the friction member 95 and is circumferentially engaged with the corresponding projection 92 to serve as a secondary engaging portion. Similarly, grooves 97 are formed at the reed valve 96.

As discussed above, the projections 92 may be formed at the vane rotor 94, and the grooves 93 may be formed at the friction member 95. Even in this way, it is possible to avoid closing of the supply oil passage 52 of the vane rotor 22 and the external supply oil passage 15 of the camshaft 13 by the friction member 95, and thereby it is possible to limit occurrence of pressure loss that would be caused by the closing of the oil passage by the friction member 95.

Third Embodiment

Figure 10:
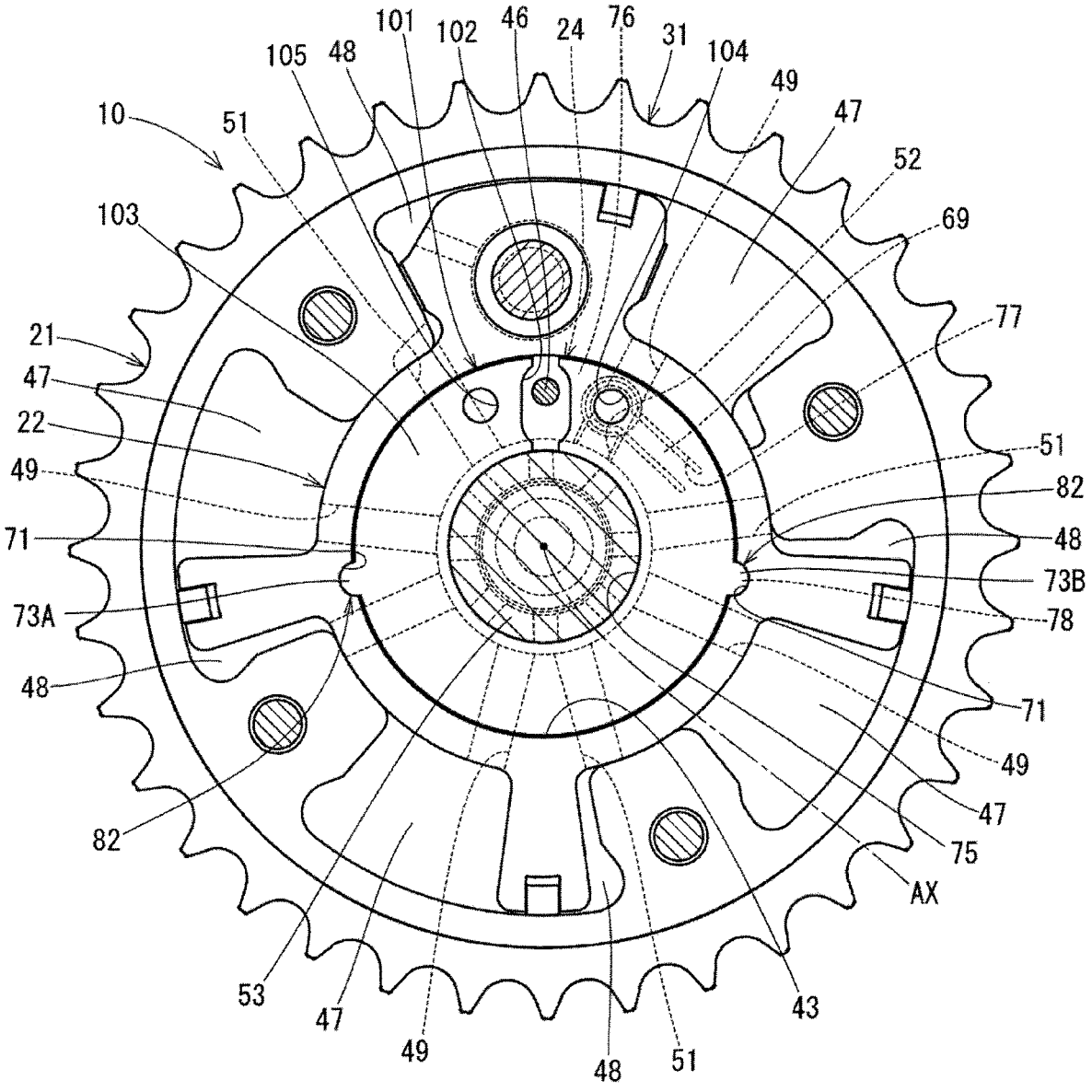
FIG. 10 is a transverse cross sectional view of a valve timing adjustment device of a third embodiment, corresponding to FIG. 5 of the first embodiment.
Figure 11:
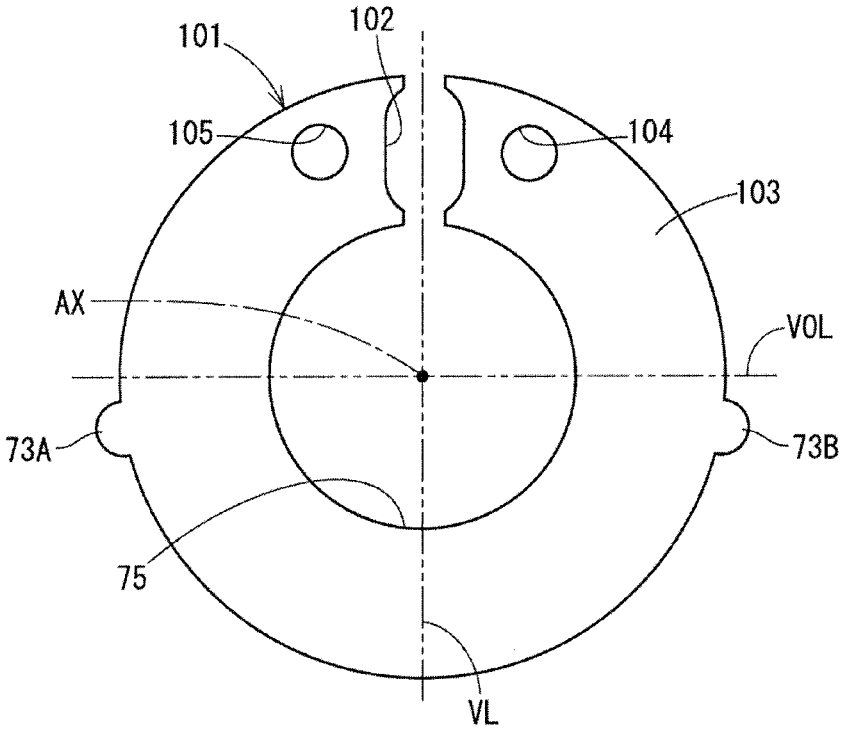
FIG. 11 is a diagram showing a friction member of FIG. 10.

In a third embodiment, as shown in FIGS. 10 and 11, the friction member 101 is a C-ring that is shaped in a form of a ring having a circumferential cutout while the C-ring has a circumferential gap 102 that corresponds to the circumferential cutout of the ring. The friction member 101 includes a main body portion 103, which has a C-shape, and two projections 73, which project from the main body portion 103. Each of the projections 73 and the corresponding groove 71 of the vane rotor 22 form the positioning arrangement 82. The groove 71 is an end-milled form and can be easily processed.

Two circumferentially opposite sides of the main body portion 103 of the friction member 101, which are opposite to each other about the circumferential gap 102, respectively have an oil passage hole 104 and a through hole 105 while the through hole 105 is a hole that is different from the oil passage hole 104. The oil passage hole 104 and the through hole 105 respectively serve as jig insertion holes. The jig insertion holes are used for deforming the friction member 101 into a cone-shape by narrowing the circumferential gap 102 through use of a jig, such as pliers. A size of the circumferential gap 102 is set to be larger than a diameter of the knock pin 46 to place the friction member 101 and the knock pin 46 into a non-contact state where the friction member 101 and the knock pin 46 do not contact with each other.

As shown in FIG. 11, in the axial view, a straight line, which extends through the rotational center of the friction member (101) and is perpendicular to the straight line VL that extends through the rotational center AX and a center of the circumferential gap 102, is defined as an imaginary perpendicular line VOL. The projections 73 are placed on the opposite side of the imaginary perpendicular line VOL, which is opposite from the circumferential gap 102.

In the axial view, the friction member 101 is shaped to be line-symmetrical with respect to the predetermined imaginary straight line VL that passes through the rotational center AX. Specifically, in the axial view, the projection 73A and the projection 73B are formed at the corresponding locations, at which the projection 73A and the projection 73B are line-symmetrical with respect to the imaginary straight line VL. A size of the oil passage hole 104 and a size of the through hole 105 are identical to each other, and the oil passage hole 104 and the through hole 105 are positioned to be line-symmetrical with respect to the imaginary straight line VL.

(Manufacturing Method)

A manufacturing method of the valve timing adjustment device of the present embodiment includes at least step 1 and step 2 discussed below.

(Step 1)

A step of forming the C-ring as the friction member 25 while the C-ring is shaped in the form of the ring having the circumferential cutout at the circumferential part of the ring, and the C-ring has the circumferential gap 102 that corresponds to the circumferential cutout of the ring.

(Step 2)

A step of assembling the friction member 101 to the vane rotor 22 by: circumferentially compressing the friction member 101 to reduce a size of the circumferential gap 102; inserting the friction member 101, which is circumferentially compressed, into the bottomed hole 43 of the vane rotor 22; and releasing the circumferential compression of the friction member 101 at a location where the inner wall surface of the groove 71 and the projection 73 are engaged with each other.

<Advantages>

As described above, in the third embodiment, the friction member 101 is the C-ring that is shaped in the form of the ring having the circumferential cutout at the circumferential part of the ring, and the friction member has the circumferential gap 102 that corresponds to the circumferential cutout of the ring. The two circumferentially opposite sides of the friction member 101, which are opposite to each other about the circumferential gap 102, respectively have the oil passage hole 104 and the through hole 105 while the through hole 105 is the hole that is different from the oil passage hole 104.

Therefore, the friction member 101 can be easily inserted into the bottomed hole 43 of the vane rotor 22 by narrowing the circumferential gap 102 through use of the jig, such as the pliers, to deform the friction member 101 into the cone-shape. In this way, the contact between the friction member 101 and the peripheral wall surface of the bottomed hole 43 can be avoided, and thereby it is possible to limit generation of a scratch at the peripheral wall surface of the bottomed hole 43.

Furthermore, in the third embodiment, the size of the circumferential gap 102 is set to be larger than the diameter of the knock pin 46 to place the friction member 101 and the knock pin 46 into the non-contact state where the friction member 101 and the knock pin 46 do not contact with each other. Thus, the interference of the insertion of the knock pin 46 by the friction member 101 can be limited.

Furthermore, according to the third embodiment, the friction member 101 includes: the main body portion 103, which is clamped between the vane rotor 22 and the camshaft 13; and the plurality of projections 73, which radially outwardly project from the main body portion 103. The primary engaging portion of the positioning arrangement 82 is the groove 71, which is the recess, and the secondary engaging portion of the positioning arrangement 82 is the projection 73, which is fitted into the groove 71. The projections 73 are placed on the opposite side of the imaginary perpendicular line VOL, which is opposite from the circumferential gap 102. In this way, the easiness of assembly is improved at the time of inserting the friction member 101 into the bottomed hole 43 of the vane rotor 22.

Furthermore, according to the third embodiment, in the axial view, the friction member 101 is shaped to be line-symmetrical with respect to the predetermined imaginary straight line VL that passes through the rotational center AX of the friction member 101. In this way, the friction member 101 can be assembled regardless of whether the front side or rear side of the friction member 101 faces the bottom of the bottomed hole 43. Thus, the easiness of assembly is improved.

Furthermore, the manufacturing method of the valve timing adjustment device according to the third embodiment includes the following two steps. The first step is the step of forming the C-ring as the friction member 25 while the C-ring is shaped in the form of the ring having the circumferential cutout at the circumferential part of the ring, and the C-ring has the circumferential gap 102 that corresponds to the circumferential cutout of the ring. The second step is the step of assembling the friction member 101 to the vane rotor 22 by: circumferentially compressing the friction member 101 to reduce the size of the circumferential gap 102; inserting the friction member 101, which is circumferentially compressed, into the bottomed hole 43 of the vane rotor 22; and releasing the circumferential compression of the friction member 101 at the location where the inner wall surface of the groove 71 and the projection 73 are engaged with each other.

Therefore, the valve timing adjustment device can be assembled to the camshaft 13 while the communicating state between the external supply oil passage 15 and the supply oil passage 52 through the oil passage hole 104 is maintained. Furthermore, the contact between the friction member 101 and the peripheral wall surface of the bottomed hole 43 can be avoided, and thereby it is possible to limit the generation of the scratch at the peripheral wall surface of the bottomed hole 43.

Fourth Embodiment

Figure 12:
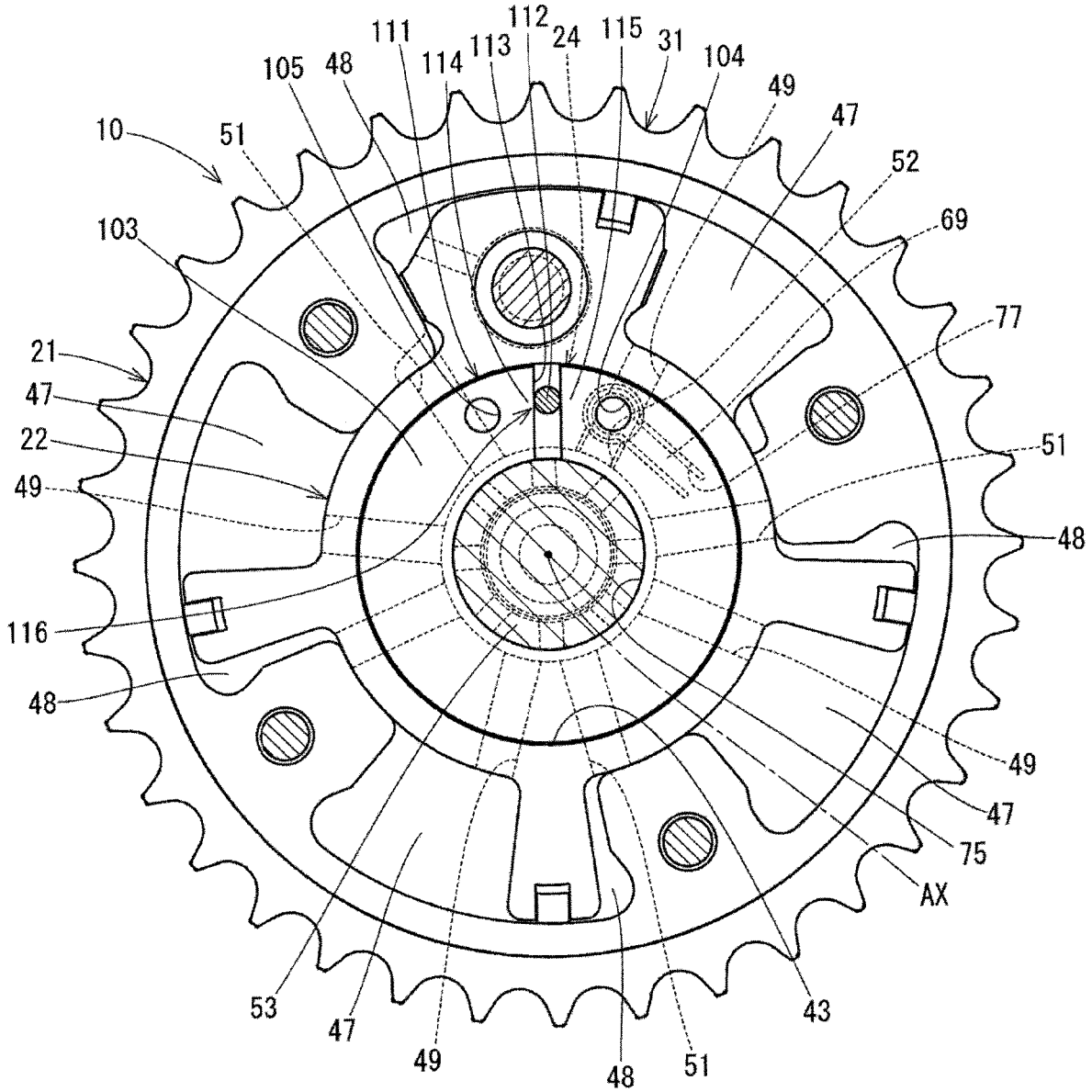
FIG. 12 is a transverse cross sectional view of a valve timing adjustment device of a fourth embodiment, corresponding to FIG. 5 of the first embodiment.

In the fourth embodiment, as shown in FIG. 12, a friction member 111 is a C-ring. A knock pin 112 is configured such that the knock pin 112 is inserted through a circumferential gap 113 of the friction member 111. A width of the circumferential gap 113 is substantially equal to the diameter of the knock pin 112. The knock pin 112 is circumferentially engaged with one circumferential end part 114 and the other circumferential end part 115 of the friction member 111. The positioning arrangement 116 includes: the knock pin 112, which serves as a primary engaging portion; and the one circumferential end part 114 and the other circumferential end part 115, which serve as secondary engaging portions.

As discussed above, the positioning arrangement 116 may include the knock pin 112, the one circumferential end part 114 and the other circumferential end part 115 of the friction member 111. In this way, it is possible to limit the generation of the scratch at the peripheral wall surface of the bottomed hole 43 by circumferentially compressing the friction member 111, and it is possible to implement the positioning arrangement 82 by using the circumferential gap 113, which enables the circumferential compression of the friction member 111, and the preexisting knock pin 112. Therefore, it is not required to form, for example, the groove(s) and the projection(s).

Fifth Embodiment

Figure 13:
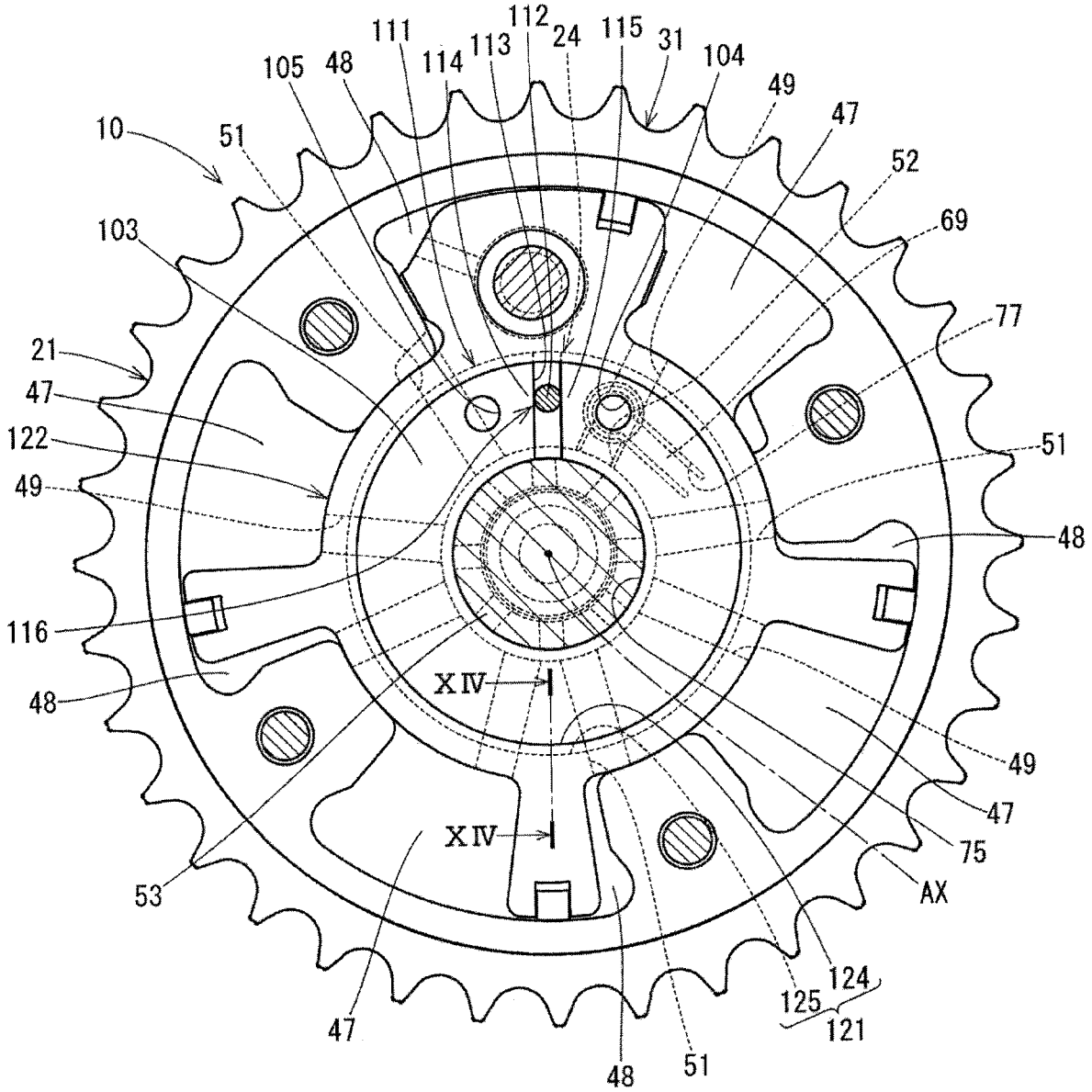
FIG. 13 is a transverse cross sectional view of a valve timing adjustment device of a fifth embodiment, corresponding to FIG. 5 of the first embodiment.
Figure 14:
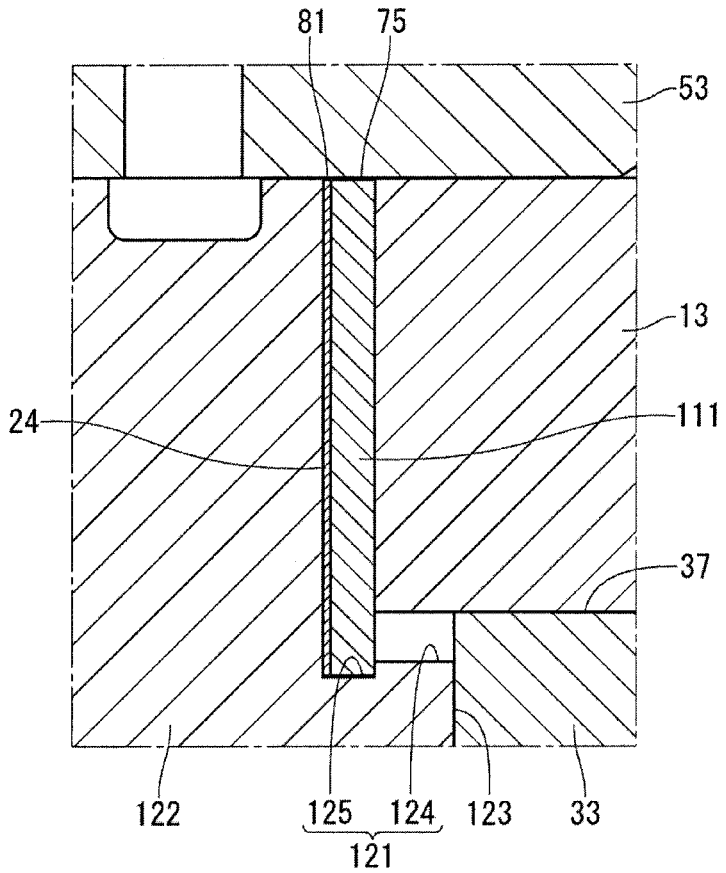
FIG. 14 is a cross sectional view taken along line XIV-XIV in FIG. 12.

In a fifth embodiment, as shown in FIGS. 13 and 14, a bottomed hole 121 includes an insertion portion 124, which axially extends from an end surface 123 of a vane rotor 122, and an annular groove 125, which is located at a bottom part of the insertion portion 124. The friction member 111 has an outer diameter, which is larger than an inner diameter of the insertion portion 124, and the friction member 111 is fitted into the annular groove 125.

As discussed above, by fitting the friction member 111 into the annular groove 125, the falling down of the friction member 111 can be reliably limited. The outer diameter of the friction member 111 is temporarily reduced by circumferentially compressing the friction member 111 to reduce a size of the circumferential gap 113. Thereby, the friction member 111 can be inserted into the annular groove 125 through the insertion portion 124.

Other Embodiments

In another embodiment, it is only required that the spool valve has at least the sleeve, and the threaded portion may be eliminated from the spool valve. The valve timing adjustment device may be fixed to the camshaft with another type of bolt that is other than the sleeve bolt. In another embodiment, the reed valve may be eliminated.

In another embodiment, the number of the positioning arrangement(s) may be one or three or more. In another embodiment, the circumferential positions of the grooves of the positioning arrangement may be different from the circumferential positions of the vanes. In another embodiment, the projecting direction of the projection of each positioning arrangement and the recessing direction of the corresponding recess of the positioning arrangement are not limited to the radial direction and may be changed to the axial direction. In another embodiment, the friction member may not be line-symmetrical with respect to the predetermined imaginary straight line in the axial view.

In another embodiment, the bottomed hole may be eliminated from the vane rotor. The friction member may be provided at, for example, an inside of the rear plate. At this time, for example, each positioning arrangement may include: a projection, which axially projects from one of the vane rotor and the friction member; and a recess, which is formed at the other one of the vane rotor and the friction member. Furthermore, the shaft insertion hole of the rear plate is shaped into the stepped form having the large diameter on the vane rotor side. When the friction member is installed to the large diameter portion of the stepped hole, the falling down of the friction member is limited.

In another embodiment, at the time of circumferentially compressing the friction member in the form of the C-ring, only the through hole, which is other than the oil passage hole and the pin insertion hole, may be used. Furthermore, the friction member may be circumferentially compressed through use of the other portion(s), such as the projections and/or the recesses, which are other than the through hole.

In another embodiment, the spool valve may be eliminated from the center part of the valve timing adjustment device. That is, the spool valve may be provided at the outside of the valve timing adjustment device. Furthermore, the oil passage hole of the friction member is not necessarily communicated with the supply oil passage. Alternatively, the oil passage hole of the friction member may be communicated with, for example, the advancing oil passage, the retarding oil passage or the drain oil passage. In another embodiment, the knock pin may be eliminated. In another embodiment, the valve timing adjustment device may be configured to adjust the valve timing of exhaust valves of the internal combustion engine.

The present disclosure should not be limited to the above embodiments and may be implemented in various other forms without departing from the scope of the present disclosure.

The present disclosure is described with reference to the embodiments. However, the present disclosure should not be limited to the embodiments and the structures described therein. The present disclosure covers various modifications and variations on the scope of equivalents. Also, various combinations and forms as well as other combinations, each of which includes only one element or more or less of the various combinations, are also within the scope and spirit of the present disclosure.

What is claimed is:

1. A valve timing adjustment device to be placed in a drive force transmission path, which transmits a drive force from a drive shaft of an internal combustion engine to a driven shaft of the internal combustion engine, while the valve timing adjustment device is configured to adjust valve timing of a valve that is opened and closed by the driven shaft, the valve timing adjustment device comprising:

a housing that is configured to be rotated synchronously with a first shaft that is one of the drive shaft and the driven shaft;

a vane rotor that is fixed to an end part of a second shaft, which is the other one of the drive shaft and the driven shaft, to rotate synchronously with the second shaft, wherein the vane rotor includes a vane that partitions an inside space of the housing into a primary oil pressure chamber placed at one circumferential side and a secondary oil pressure chamber placed at another circumferential side, and the vane rotor is configured to rotate relative to the housing according to a pressure of hydraulic oil, which is supplied to the primary oil pressure chamber, and a pressure of the hydraulic oil, which is supplied to the secondary oil pressure chamber;

a friction member that is clamped between the second shaft and the vane rotor and includes an oil passage hole, wherein the oil passage hole communicates between a first oil passage, which is opened at an axial end surface of the second shaft, and a second oil passage, which is opened at an axial end surface of the vane rotor; and at least one positioning arrangement that includes a primary engaging portion, which is provided at the vane rotor, and a secondary engaging portion, which is provided to the friction member and is configured to circumferentially engage with the primary engaging portion, wherein:

the at least one positioning arrangement is configured to limit relative rotation between the vane rotor and the friction member in a communicating state where the first oil passage and the second oil passage are communicated with each other through the oil passage hole;

the friction member includes a main body portion, which is clamped between the vane rotor and the second shaft, and a projection, which radially outwardly projects from the main body portion;

the primary engaging portion is a recess;

the secondary engaging portion is the projection that is fitted into the recess; and an axial thickness of the projection is equal to an axial thickness of the main body portion.

2. The valve timing adjustment device according to claim 1, wherein the projection is one of at least two projections that include a first projection and a second projection, and in an axial view, the first projection is placed on an opposite side of a rotational center of the friction member, which is opposite from the second projection.

3. A valve timing adjustment device to be placed in a drive force transmission path, which transmits a drive force from a drive shaft of an internal combustion engine to a driven shaft of the internal combustion engine, while the valve timing adjustment device is configured to adjust valve timing of a valve that is opened and closed by the driven shaft, the valve timing adjustment device comprising:

a housing that is configured to be rotated synchronously with a first shaft that is one of the drive shaft and the driven shaft;

a vane rotor that is fixed to an end part of a second shaft, which is the other one of the drive shaft and the driven shaft, to rotate synchronously with the second shaft, wherein the vane rotor includes a vane that partitions an inside space of the housing into a primary oil pressure chamber placed at one circumferential side and a secondary oil pressure chamber placed at another circumferential side, and the vane rotor is configured to rotate relative to the housing according to a pressure of hydraulic oil, which is supplied to the primary oil pressure chamber, and a pressure of the hydraulic oil, which is supplied to the secondary oil pressure chamber;

a friction member that is clamped between the second shaft and the vane rotor and includes an oil passage hole, wherein the oil passage hole communicates between a first oil passage, which is opened at an axial end surface of the second shaft, and a second oil passage, which is opened at an axial end surface of the vane rotor; and at least one positioning arrangement that includes a primary engaging portion, which is provided at the vane rotor, and a secondary engaging portion, which is provided to the friction member and is configured to circumferentially engage with the primary engaging portion, wherein:

the at least one positioning arrangement is configured to limit relative rotation between the vane rotor and the friction member in a communicating state where the first oil passage and the second oil passage are communicated with each other through the oil passage hole;

the friction member includes a main body portion, which is clamped between the vane rotor and the second shaft, and a projection, which radially outwardly projects from the main body portion;

the primary engaging portion is a recess;

the secondary engaging portion is the projection that is fitted into the recess;

the projection is one of at least two projections that include a first projection and a second projection, and in an axial view, the first projection is placed on an opposite side of a rotational center of the friction member, which is opposite from the second projection;

the first projection and the second projection are opposed to each other about the rotational center; and an axial thickness of each of the first projection and the second projection is equal to an axial thickness of the main body portion.

4. A valve timing adjustment device to be placed in a drive force transmission path, which transmits a drive force from a drive shaft of an internal combustion engine to a driven shaft of the internal combustion engine, while the valve timing adjustment device is configured to adjust valve timing of a valve that is opened and closed by the driven shaft, the valve timing adjustment device comprising:

a housing that is configured to be rotated synchronously with a first shaft that is one of the drive shaft and the driven shaft;

a vane rotor that is fixed to an end part of a second shaft, which is the other one of the drive shaft and the driven shaft, to rotate synchronously with the second shaft, wherein the vane rotor includes a vane that partitions an inside space of the housing into a primary oil pressure chamber placed at one circumferential side and a secondary oil pressure chamber placed at another circumferential side, and the vane rotor is configured to rotate relative to the housing according to a pressure of hydraulic oil, which is supplied to the primary oil pressure chamber, and a pressure of the hydraulic oil, which is supplied to the secondary oil pressure chamber;

a friction member that is clamped between the second shaft and the vane rotor and includes an oil passage hole, wherein the oil passage hole communicates between a first oil passage, which is opened at an axial end surface of the second shaft, and a second oil passage, which is opened at an axial end surface of the vane rotor; and at least one positioning arrangement that includes a primary engaging portion, which is provided at the vane rotor, and a secondary engaging portion, which is provided to the friction member and is configured to circumferentially engage with the primary engaging portion, wherein:

the at least one positioning arrangement is configured to limit relative rotation between the vane rotor and the friction member in a communicating state where the first oil passage and the second oil passage are communicated with each other through the oil passage hole;

the friction member includes a main body portion, which is clamped between the vane rotor and the second shaft, and a projection, which radially outwardly projects from the main body portion;

the primary engaging portion is a recess;

the secondary engaging portion is the projection that is fitted into the recess;

the housing includes a tubular portion, a first cover portion, which is provided to one end of the tubular portion, and a second cover portion, which is provided to another end of the tubular portion;

the second cover portion includes a shaft insertion hole, through which the second shaft is inserted;

the vane rotor includes a bottomed hole, into which the friction member is fitted;

the recess is a groove that is recessed radially outwardly at a peripheral wall portion of the bottomed hole and axially extends to an opening of the bottomed hole;

an outer diameter of the main body portion is smaller than an inner diameter of the shaft insertion hole;

a distal end of the projection is located on a radially outer side of an inner wall surface of the shaft insertion hole; and an axial thickness of the projection is equal to an axial thickness of the main body portion.

5. The valve timing adjustment device according to claim 4, wherein the projection is one of at least two projections that include a first projection and a second projection, and in an axial view, the first projection is placed on an opposite side of a rotational center of the friction member, which is opposite from the second projection.

6. The valve timing adjustment device according to claim 4, wherein a radial length of a portion of the projection, which is located on a radially outer side of the inner wall surface of the shaft insertion hole, is larger than an axial distance between the projection and the second cover portion.

7. A valve timing adjustment device to be placed in a drive force transmission path, which transmits a drive force from a drive shaft of an internal combustion engine to a driven shaft of the internal combustion engine, while the valve timing adjustment device is configured to adjust valve timing of a valve that is opened and closed by the driven shaft, the valve timing adjustment device comprising:

a housing that is configured to be rotated synchronously with a first shaft that is one of the drive shaft and the driven shaft;

a vane rotor that is fixed to an end part of a second shaft, which is the other one of the drive shaft and the driven shaft, to rotate synchronously with the second shaft, wherein the vane rotor includes a vane that partitions an inside space of the housing into a primary oil pressure chamber placed at one circumferential side and a secondary oil pressure chamber placed at another circumferential side, and the vane rotor is configured to rotate relative to the housing according to a pressure of hydraulic oil, which is supplied to the primary oil pressure chamber, and a pressure of the hydraulic oil, which is supplied to the secondary oil pressure chamber;

a friction member that is clamped between the second shaft and the vane rotor and includes an oil passage hole, wherein the oil passage hole communicates between a first oil passage, which is opened at an axial end surface of the second shaft, and a second oil passage, which is opened at an axial end surface of the vane rotor; and at least one positioning arrangement that includes a primary engaging portion, which is provided at the vane rotor, and a secondary engaging portion, which is provided to the friction member and is configured to circumferentially engage with the primary engaging portion, wherein:

the at least one positioning arrangement is configured to limit relative rotation between the vane rotor and the friction member in a communicating state where the first oil passage and the second oil passage are communicated with each other through the oil passage hole;

in an axial view, the friction member, which includes the secondary engaging portion of the at least one positioning arrangement, is shaped to be line-symmetrical with respect to a predetermined imaginary straight line that passes through a rotational center of the friction member;

the primary engaging portion is a recess;

the secondary engaging portion is a projection that projects from a main body of the friction member and is fitted into the recess; and an axial thickness of the projection is equal to an axial thickness of the main body portion.

8. The valve timing adjustment device according to claim 7, wherein the at least one positioning arrangement is a plurality of positioning arrangements that are placed one after another in a circumferential direction.

* * * * *